US007931173B2

(12) United States Patent
Yuan

(10) Patent No.: US 7,931,173 B2
(45) Date of Patent: Apr. 26, 2011

(54) LIQUID DISPENSER

(76) Inventor: Jianjun Yuan, Yuyao (CN)

( * ) Notice: Subject to any disclaimer, the term of this patent is extended or adjusted under 35 U.S.C. 154(b) by 905 days.

(21) Appl. No.: 11/888,180

(22) Filed: Jul. 31, 2007

(65) Prior Publication Data

US 2008/0029547 A1 Feb. 7, 2008

(30) Foreign Application Priority Data

Aug. 2, 2006 (CN) ..... 2006 2 0106314 U

(51) Int. Cl.
*B65D 37/00* (2006.01)

(52) U.S. Cl. ..... 222/207; 222/380; 222/476; 222/496

(58) Field of Classification Search ..... 222/207, 222/209, 380, 383.1, 476, 495, 496, 497
See application file for complete search history.

(56) References Cited

U.S. PATENT DOCUMENTS 3,220,611 A * 11/1965 Zander et al. ..... 222/95
4,182,496 A * 1/1980 Burke ..... 239/492
4,330,071 A * 5/1982 Ohlson ..... 222/207
4,830,284 A * 5/1989 Maerte ..... 239/333
4,917,265 A * 4/1990 Chiang ..... 222/52
5,042,697 A * 8/1991 Warren ..... 222/402.1
5,195,665 A * 3/1993 Lina ..... 222/496
5,842,616 A * 12/1998 Ruscitti et al. ..... 222/321.3
6,012,613 A * 1/2000 Chen ..... 222/207
6,062,433 A * 5/2000 Fuchs ..... 222/153.13
6,752,295 B2 * 6/2004 Weber ..... 222/209

* cited by examiner

*Primary Examiner* — Kenneth Bomberg
*Assistant Examiner* — Daniel R Shearer
(74) *Attorney, Agent, or Firm* — Hamre, Schumann, Mueller & Larson, P.C.

(57) ABSTRACT

A liquid dispenser is described and includes a cover connecting to the opening of a container and a main body connecting to the cover. The main body includes a chamber in communication with the cover and a liquid outlet for liquid discharge, wherein a liquid output device is arranged in the chamber, a button is arranged on the main body for controlling the action of the liquid output device, a one-way valve is arranged in the liquid output device for adjusting the open/close state of a liquid output passage. The liquid dispenser described is novel in design, simple and compact in construction. The liquid dispenser described can employ the operating principle of a one-way valve so as to realize liquid discharge in any direction.

11 Claims, 12 Drawing Sheets

LIQUID DISPENSER

TECHNICAL FIELD

The technical disclosure herein relates to a liquid dispenser. The liquid dispenser described can be installed at the opening of a container, which can be used for holding viscous liquid, for example, medical preparation, shampoo, body wash, hand wash, etc., while the liquid dispenser is used to extract appropriate amount of liquid from the container.

BACKGROUND ART

The publicly-known liquid dispenser normally has a liquid output member arranged at the center of a cover mounted at a container opening. A head cap is installed at the upper end of the liquid output member. Using the principle of air pump, i.e. applying a force by a user's hand to press the liquid output member, this publicly-known liquid dispenser makes the liquid in the container flow out via an outlet formed in the head cap. As a result, the user can use one of his palms to receive the liquid flowing out of the outlet while using the other palm to keep pressing the head cap so as to extract an appropriate amount of liquid contained in the container. However, at present the publicly-known liquid dispenser requires more parts to be built. The structure is complicated while not compact in construction. Furthermore, after the dispenser is assembled with the container, it cannot be used to output liquid in any direction because of its internal structure.

SUMMARY

The technical problem to be solved by the disclosure herein is to provide an improved liquid dispenser over the aforesaid state of the art, and which is novel in design, simple and compact in construction, while providing a good effect when in use. Furthermore, it can be used in any direction without affecting normal function.

The technical solution adopted by the present disclosure to solve the aforesaid problems is: A novel liquid dispenser with a cover connecting to the opening of a container, characterized in that it further comprises a main body connecting to the cover; the main body comprises a chamber connecting to the cover and a liquid outlet for discharging liquid, wherein a liquid output device is disposed in the chamber; a button is arranged on the main body for controlling the action of the liquid output device which is equipped with an one-way valve to adjust the open/close state of the liquid output passage.

The top part of said cover may comprise a circular tube for connecting to the main body. Said main body and the circular tube are rotationally engaged, and a sealing ring is arranged in the junction between the two.

The outer wall of said main body is arranged with an embedded slot for embedding a push button. The peripheral edge of the button is inserted in the embedded slot and positioned through a retaining ring.

The liquid output device can be realized by many different technical solutions. Two examples of technical solutions are as follows:

First, the liquid output device comprises a water-sealing ring positioned in the chamber of the main body, the water-sealing ring comprises an axial opening at the center thereof; said one-way valve is a valve plate I disposed in the main body. Said valve plate I is movably positioned with respect to the water-sealing ring, a spring is arranged at the rear of the valve plate I; said button is arranged on the main body, an opening is arranged in the button at the side wall of the main body between the water-sealing ring and the valve plate I.

Second, the liquid output device comprises a piston and a water-sealing ring configured together with the piston and positioned in the chamber, said one-way valve is a valve plate disposed in the main body. The valve plate II covers on the piston and is positioned at the opening of the cover, a spring is arranged at the rear of the valve plate II; said button is arranged on the main body, an opening is arranged in the button at the side wall of the main body between the water-sealing ring and the valve plate. The cross-section of said piston is in cross-like shape, and a plurality of slots are arranged at the outer wall of the upper part thereof. The upper part and the tail part of said piston are respectively slidingly inserted into the opening of the water-sealing ring and the axial opening of the cover.

For the aforesaid two liquid output devices of different constructions, wherein the construction of said valve plate I, II are also different. The upper part of the valve plate I is a cylindrical body slidingly engaged with the axial opening of the water-sealing ring and a plurality of axial slots are arranged on the outer wall of the cylindrical body; the lower part is a cylindrical cover-shaped body having an increasing outer radius, a top surface with a hollow core and can be engaged with the sealing side of the water-sealing ring. The outward extension of the bottom of the cover-shaped body comprises a plate-like annular plane which can engage with the sealing side of the opening of the cover.

The valve plate II comprises a circular tube for configuring with the piston. The peripheral extension of the circular tube comprises a plate-like annular plane which can engage with the sealing side of the opening of the cover.

Besides the two different technical solutions as mentioned above, further modifications can be made on the basis of the two solutions, for instance, extending a circular tube upward and downward on the valve plate I according to the aforesaid structural basis, wherein the upper circular tube is inserted into the chamber of the main body and the two are sealingly engaged. The lower circular tube covers an inner circular tube of the cover and the two are sealingly engaged. This allows the liquid to pass through orifices outside the inner circular tube of the cover, avoiding the spring and the valve from being in contact with the liquid.

Similarly, if the circular annular water-sealing ring in for example the second solution is modified, liquid discharge in the form of foam can be realized. Specifically, the water-sealing ring comprises a circular tube with an upper section of reducing radius and there is a depression on its top part, and more than one slot in communication with the axial opening of the circular tube. A circular annular plane is formed at the outward extension of the bottom of the circular tube. This circular annular plane is sealingly engaged with the inner wall of the main body. Said water-sealing ring is arranged between the piston and a cylindrical chamber at the upper part of the main body. The upper section of the water-sealing ring is inserted into the cylindrical chamber at the upper part of the main body and are sealingly engaged. There is a partition plate formed inside the opening of said main body. Orifices are arranged at the partition plate and between the partition plate and the main body wall. Long slots are arranged at one side of the opening in communication with the inner chamber. Additionally, the opening of the main body comprises a stainless-steel mesh piece which is welded on the locking slot. This allows the liquid to pass through the slots on the water-sealing ring and the series of orifices, long slots etc in order to be ejected in form of foam.

In comparison with the state of art, the advantages of the present invention are as follows:

1. Since the liquid dispenser described employs the operation principle of one-way valve, this liquid dispenser can make liquid discharge in any direction without affecting the usage;
2. Instead of having any head cap of such conventional liquid dispensers, the liquid dispenser herein realizes the liquid dispensing function of liquid by pressing a button. Therefore, the liquid dispenser can minimize the use of space;
3. The dispenser herein is compact in construction with less parts;
4. At the same time, this liquid dispenser can function as a vacuum liquid dispenser, by making the mated piston type container, having for example a double-layer thin film flexible container, reduce in volume as the liquid inside reduces. Such as configuration can avoid any air contact with unused liquid during storage.

DETAILED EMBODIMENTS

The following will give further detailed description for the liquid dispenser through the embodiments together with the attached drawings.

Embodiment 1

Figure 1:
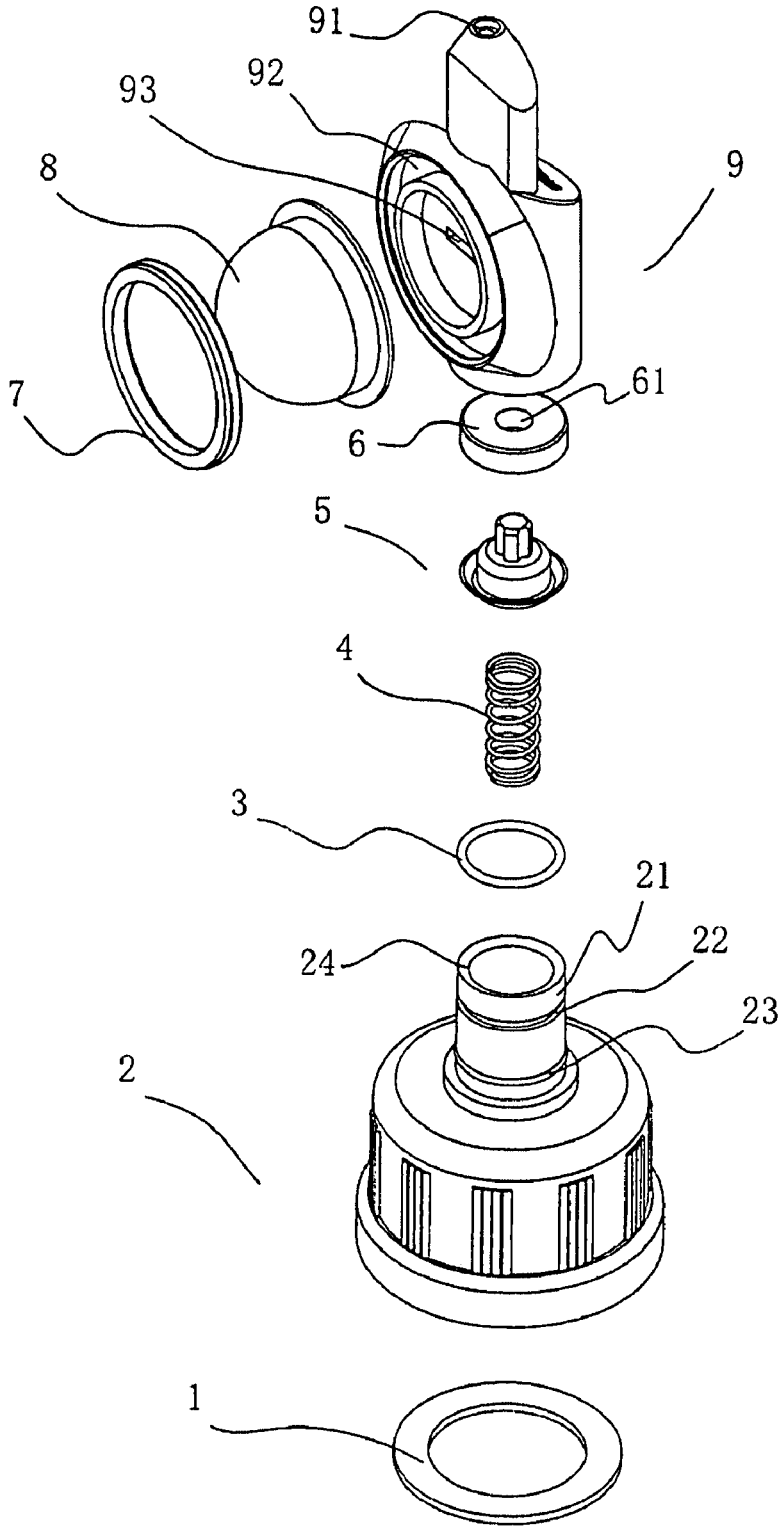
FIG. 1 Exploded 3-D schematic view of one embodiment 1 of a liquid dispenser.

Please refer to FIG. 1, this novel liquid dispenser mainly includes cover 2, main body 9 and liquid output device comprising button 8, water-sealing ring 6 and spring 4, and valve plate 5 with the effect of a 2-in-1 one-way valve, etc., wherein:

Cover 2 engages with the opening of the container and in the cover 2 there is a padding piece 1 to ensure it is sealed with the container. On the top of the cover 2 there is a circular tube 21 for connecting to the main body. On the circular tube 21 there is an annular slot 22 for embedding O-shaped sealing ring and an annular flange 23 buckled with the main body.

The main body 9 is hollow. The inner wall of the lower part of the main body is rotationally engaged with the outer wall of the circular tube 21 of the cover and on the inner wall of the main body 9. There is an annular slot that can connect the main body 9 to the circular tube 21, such as by being buckled with the annular flange 23 of the cover. Said main body 9 is rotationally connected to the cover 2 after its annular slot buckles with the annular flange of the cover 2 and the sealing between them is ensured by means of the O-shaped sealing ring 3 embedded on the circular tube 21. And after having the main body 9 connected to the cover 2, its hollow chamber is in communication with the inner chamber of the cover. In addition, on the top of the main body 9 there is a liquid outlet 91 from which the liquid is discharged. On the outer wall of the main body there is annular embedded slot 92 for embedding the button, and a small opening 93 is arranged at the outer wall of the main body in the area of the annular embedded slot.

The button 8 is arranged on the main body 9 with its outer edge embedded in the embedded slot 92 of the outer wall of said main body and positioned by the buckle ring 7 to be embedded in the embedded slot.

The water-sealing ring 6 is arranged inside the main body 9, positioned on the inner wall which is located at the front part of the opening and the outer wall of the water-sealing ring and the inner wall of the main body are sealingly engaged. The hollow chamber of said main body 9 is divided into front part and rear part by the water-sealing ring 6. The appearance of the water-sealing ring is a circular ring with an axial opening 61 at the center thereof and its bottom end is an opening in shape of a conical horn.

Figure 8:
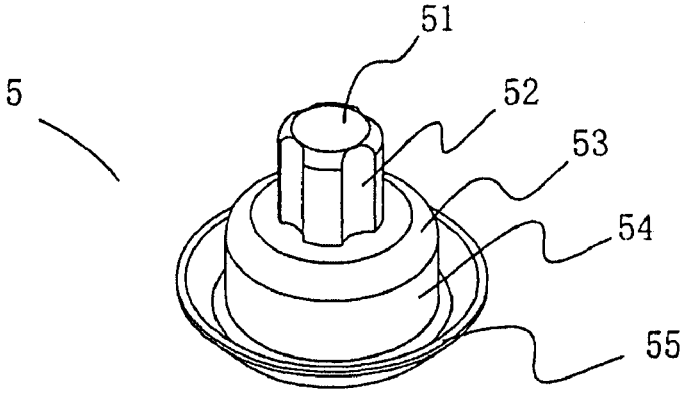
FIG. 8 Exploded enlarged schematic view of one embodiment of a valve plate I.
Figure 9:
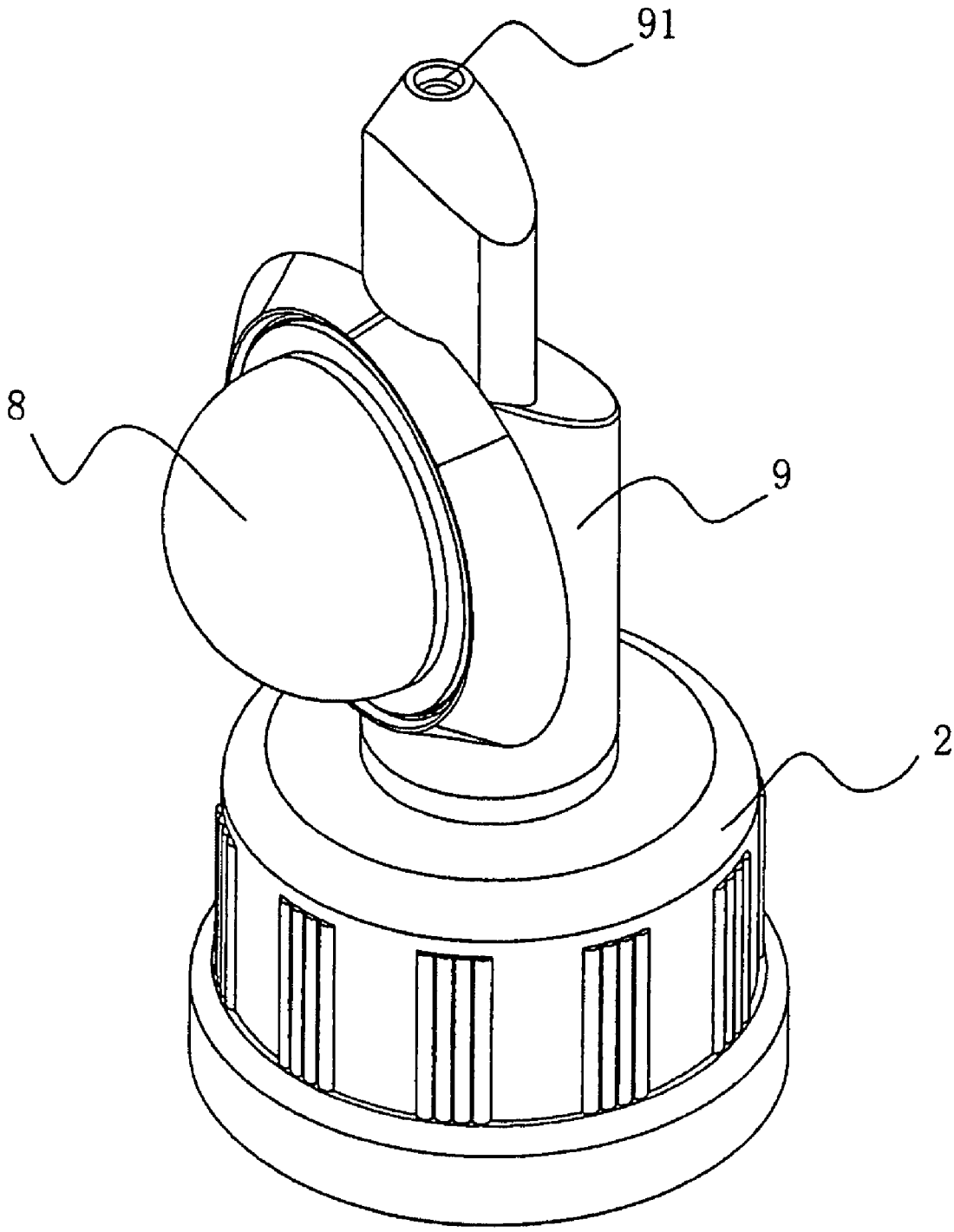
FIG. 9 Outline schematic view of embodiment 1.

The construction of the valve plate 5 is shown in FIG. 8. It has the function of one-way valve. The upper part of the valve plate 5 is a cylindrical body 51 which is slidingly inserted into the axial opening 61 of the water sealing ring and a plurality of axial slots 52 are arranged on its outer wall for liquid to pass through the slots 52. The lower part of the valve plate 5 is a hollow cylindrical cover-shaped body 54 with an increasing outer radius. The edge part of its top surface is a fillet 53 which can sealingly engage with the slant surface 62 of the conical horn opening of the water-sealing ring. The bottom part of the cover-shaped body is outwardly extended in form of a plate-like annular plane 55 which can sealingly engage with the opening 24 of the cover 2. The valve plate 5 is constructed of a material with high elasticity. The plate-like annular plane 55 at the peripheral can contract radially. A spring 4 is arranged at the rear of the valve 5. One end of this spring is against the valve plate 5, the other end covers the positioning shaft of the cover 2. Said opening 93 on the side wall of said main body 9 is positioned between the water-sealing ring 6 and the valve plate 5.

Figure 3:
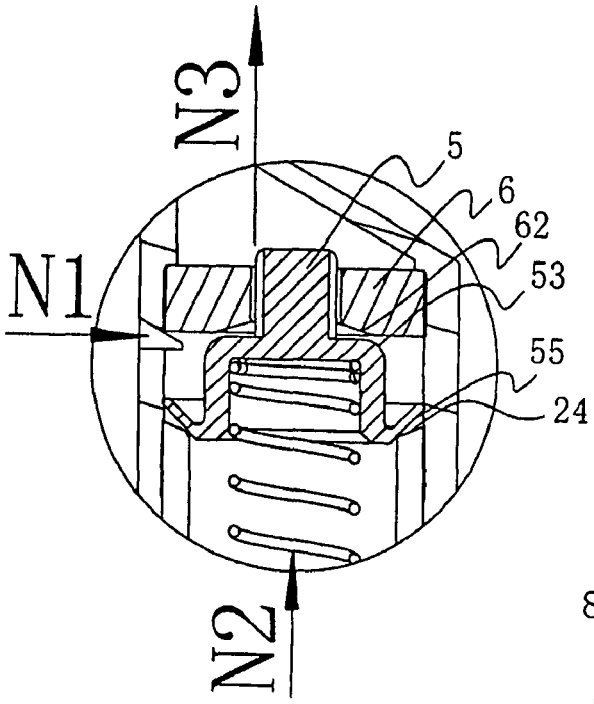
FIG. 3 Enlarged partial view of FIG. 2.
Figure 2:
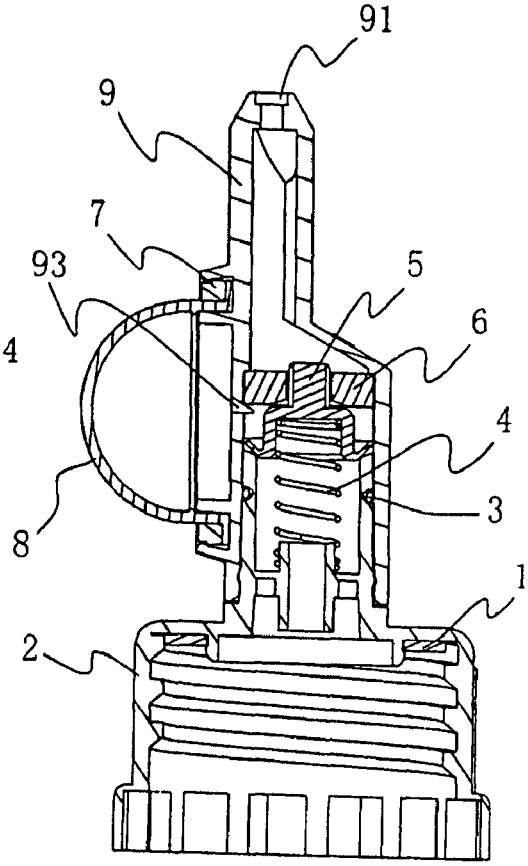
FIG. 2 Structural schematic view of embodiment 1 at the opening state of liquid output passage.
Figure 4:
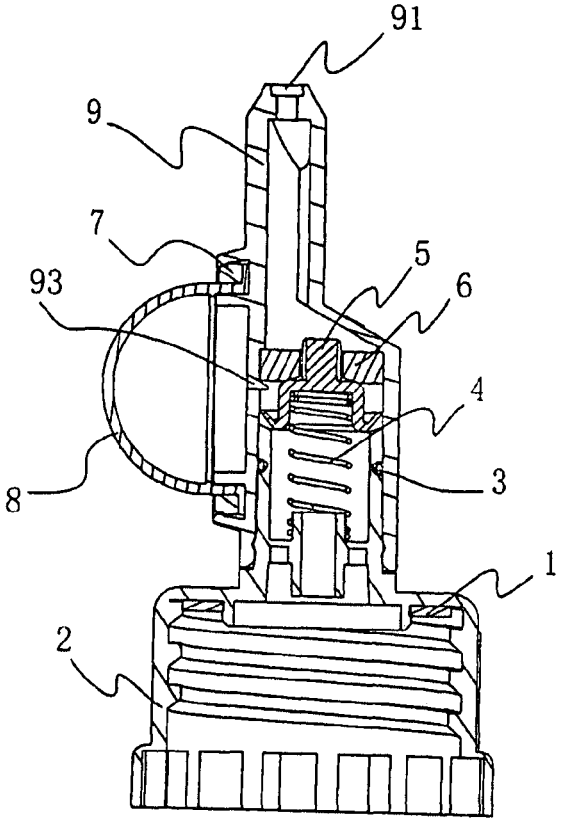
FIG. 4 Structural schematic view of embodiment 1 at the closing state of liquid output passage.
Figure 5:
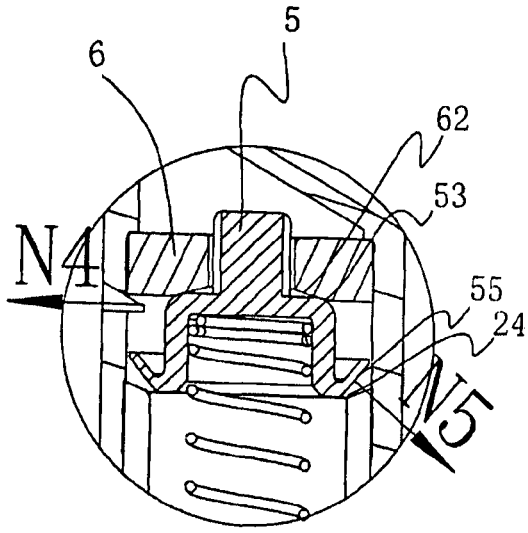
FIG. 5 Enlarged partial view of FIG. 4.
Figure 6:
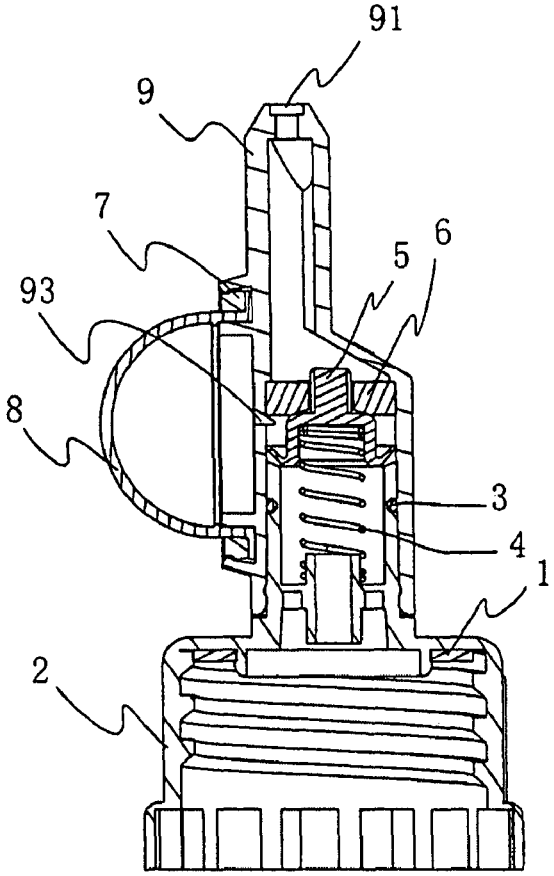
FIG. 6 Structural schematic view of embodiment 1 at non-operating state under normal circumstances.
Figure 7:
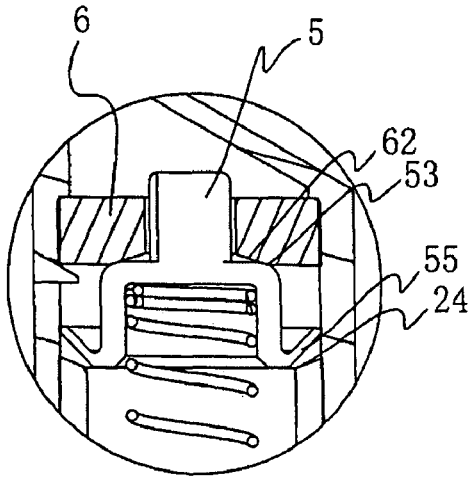
FIG. 7 Enlarged partial view of FIG. 6.

This liquid dispenser is installed on a mated container. In operation, the button 8 can be pressed by hand to produce compressed liquid. When the pressure N1 of the compressed liquid becomes larger than the elastic force N2 of the spring 4 behind the valve plate 5, the valve plate 5 is separated from the joint with the water-sealing ring 6 and the compressed liquid generated will flows out of the liquid outlet 91 through the water-sealing ring, as shown in FIG. 2, FIG. 3; The pressure N of the liquid applied on the valve plate 5 (the pressure difference between the pressure N1 of the compressed liquid and the pressure N3 discharged with liquid through the water-sealing ring) overcomes the elastic force of the spring 4 in the end. When this pressure is less than the elastic force, the spring 4 again makes the valve plate 5 restore to its original position and simultaneously seal with the water-sealing ring; When the button 8 is restored, the suction force N4 produced by restoration of the button 8 makes the valve plate 5 radially contract (its suction force is larger than the elastic deformation force N5 of the valve plate 5). In the meantime the liquid at the rear of the valve plate 5 is sucked, as shown in FIG. 4, FIG. 5, when the button is restored, the liquid will fill between the valve plate 5 and the water sealing ring 6. The valve plate 5 will restore as it is no longer subject to the action of the suction force N4, as shown in FIG. 6, FIG. 7. The whole dispenser then enters next operating cycle.

Embodiment 2

Figures 10, 11:
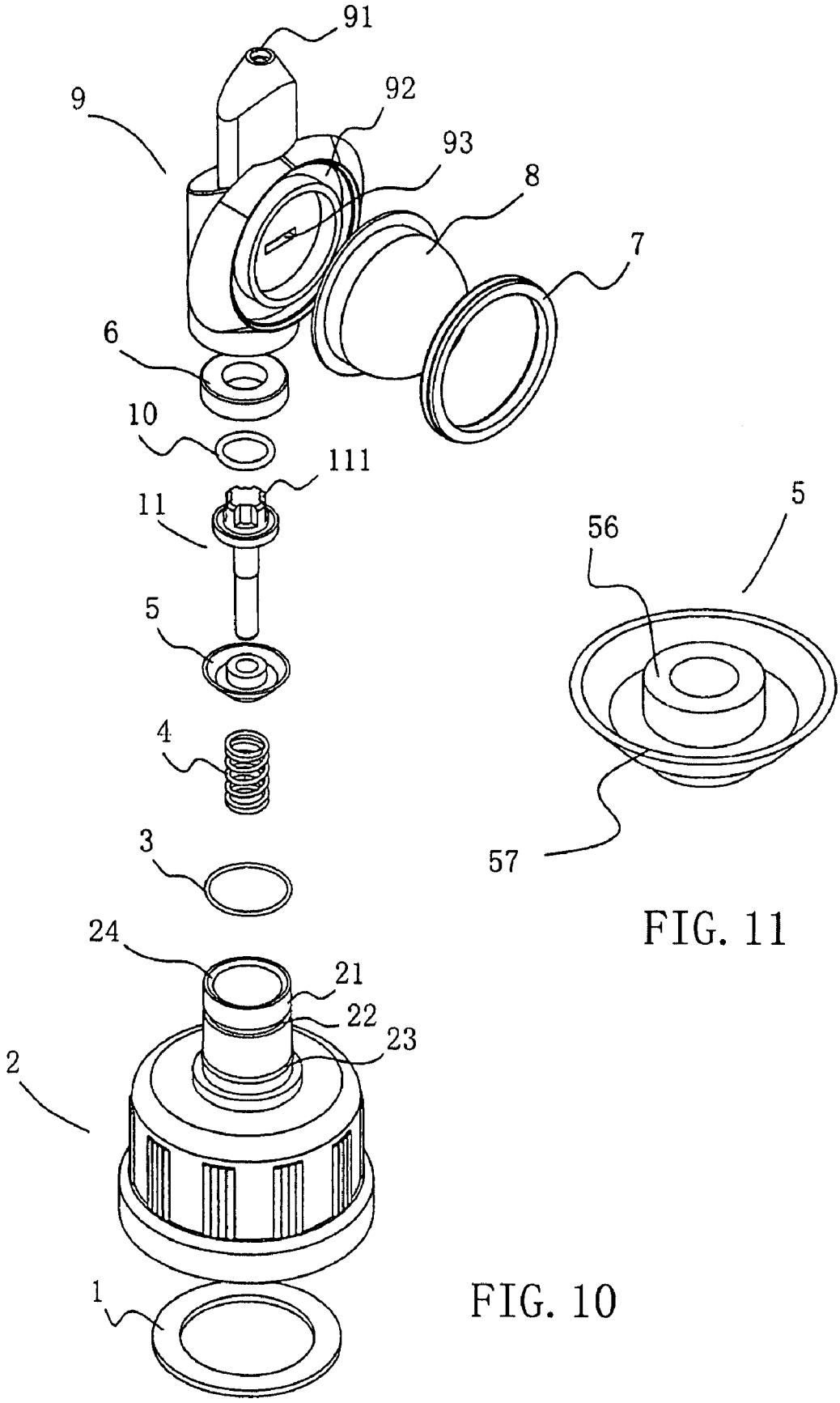
FIG. 10 Exploded 3-D schematic view of another embodiment 2 of a liquid dispenser.
FIG. 11 Exploded enlarged schematic view of one embodiment of a valve plate II.
Figure 12:
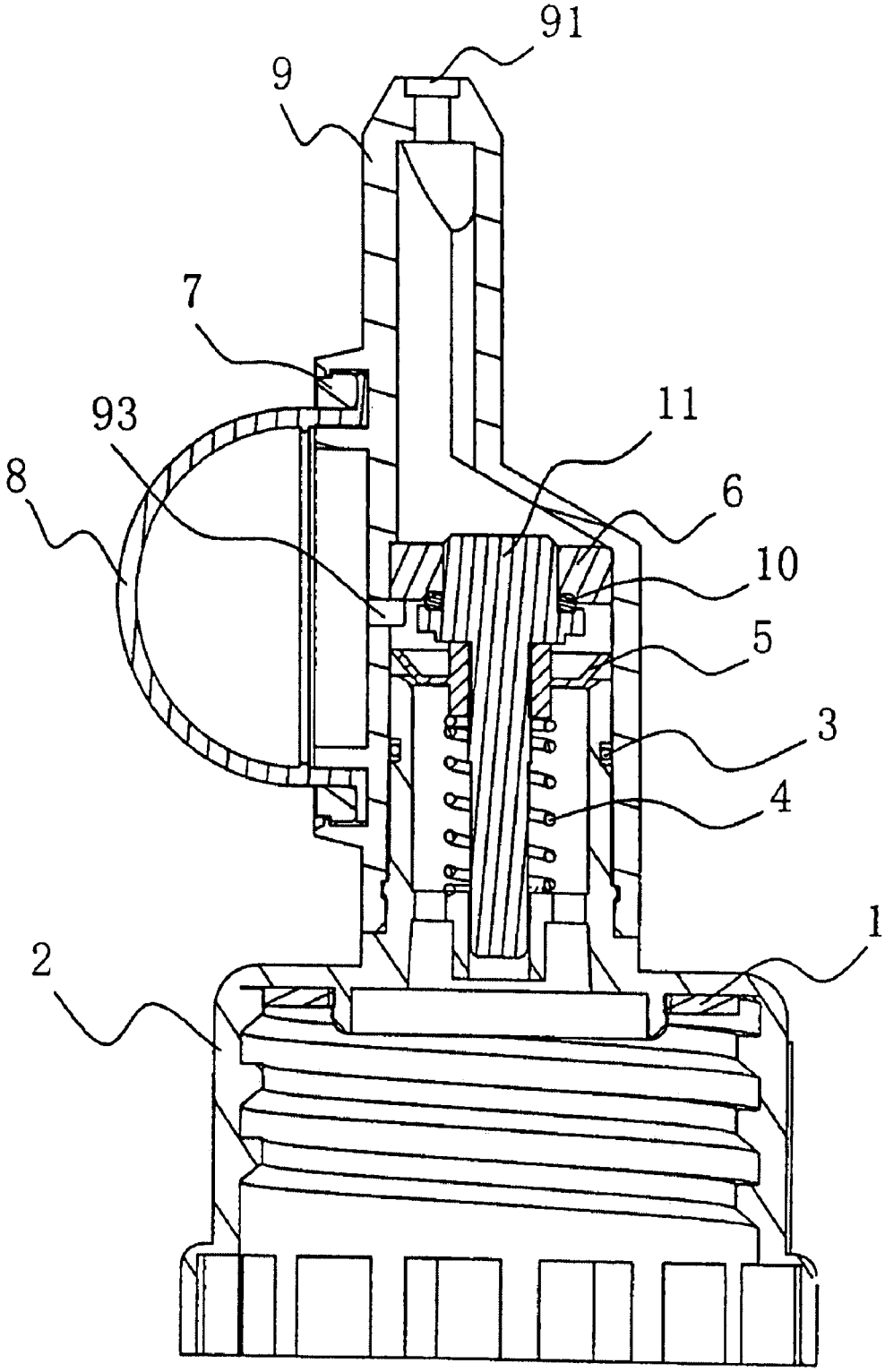
FIG. 12 Structural schematic view of embodiment 2.

The liquid dispenser as shown in FIG. 10-FIG. 12, the construction of liquid output device and valve adopted by this embodiment 2 is different from embodiment 1. The liquid output device in this embodiment is composed of button 8, piston 11, water-sealing ring 6 and spring 4, etc. The valve plate 5 also has the function of one-way valve. Its main body is also made into a plate-like shape to match with main body 9. Specifically, the valve plate 5 comprises a circular tube 56 for configuring with piston 11. The outward extension of the circular tube 56 is equipped with a plate-like annular plane 57 which can sealingly engage with the opening 24 of the cover 2. The valve plate 5 is assembled with the piston 11. The piston 11 is coupled through the valve plate 5. The valve plate 5 can close or open the opening 24 of the circular tube 21 of the cover 2. The piston 11 is a component which has a cross-like cross-section area, its upper part is inserted in the opening of the water-sealing ring 6. A plurality of axial slots 111 are arranged on its outer wall for the liquid to pass through the slots 111. An O-shaped sealing ring 10 is arranged between the water sealing ring 6 and the piston 11, being configured with the piston 11 and moving together with the piston 11. The tail part of the piston 11 is slidably inserted into the axial opening of the cover 2. A spring 4 is covered on the piston supporting the bottom of the valve plate 5. The opening 93 on the side wall of the main body 9 is also located between the water-sealing ring 6 and the valve plate 5. Said water-sealing ring is a circular ring.

The operating principle of the liquid dispenser of this embodiment is as follows: During use, press the button 8 by hand to produce compressed liquid. When the pressure of the compressed liquid becomes larger than the elastic force of the spring 4 behind the valve plate 5, it moves the valve plate 5 backward, simultaneously carrying the piston 11 and the O-shaped sealing ring 10 on the piston so as to make it separated from the joint part with the water-sealing ring 6. The compressed liquid generated flows out of the liquid outlet 91 through the water-sealing ring 6. The pressure difference between the pressure applied by the liquid on the valve plate 5 and the pressure discharged with the liquid through the water-sealing 6, it overcomes the elastic force of the spring 4 in the end. When this pressure is less than the elastic force of the spring 4, the spring 4 again promotes the restoration of the piston 11, O-shaped ring 10, valve plate 5 and simultaneously seals with the water sealing ring 6. When the button 8 is restored, the suction force produced by the restoration of the button 8 makes the valve plate 5 radially contracts (its suction force is larger than the elastic deformation force of the valve). In the meantime the liquid at the rear of the valve plate 5 is sucked so that when the button 8 is restored, the liquid will fill between the valve plate 5 and the water sealing ring 6. The valve plate 5 will restore as it is no longer subject to the action of the suction. The whole dispenser then enters next operation cycle.

Embodiment 3

This embodiment is modified on the basis of the embodiment 1. By modifying the structure of the valve plate and performing certain adaptive changes to the cover and the main body, the spring and the inner side of the valve plate can be kept out of reach of the liquid when the dispenser is discharging liquid. This can not only increase the flexibility of the product operation but also ensure the liquid quality is not affected and it is also good in terms of safety.

Figure 13:
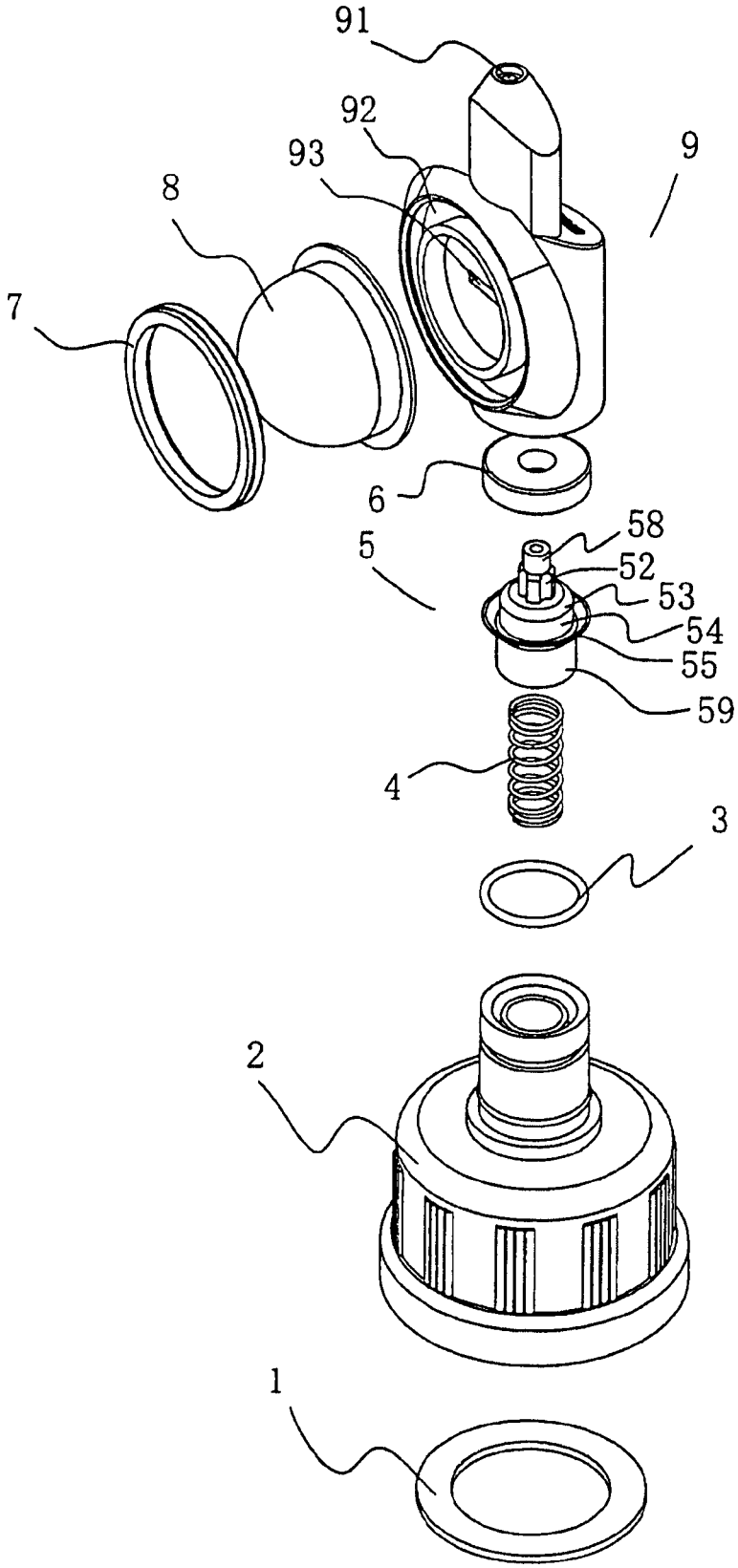
FIG. 13 Exploded 3-D schematic view of another embodiment 3 of a liquid dispenser.
Figure 14:
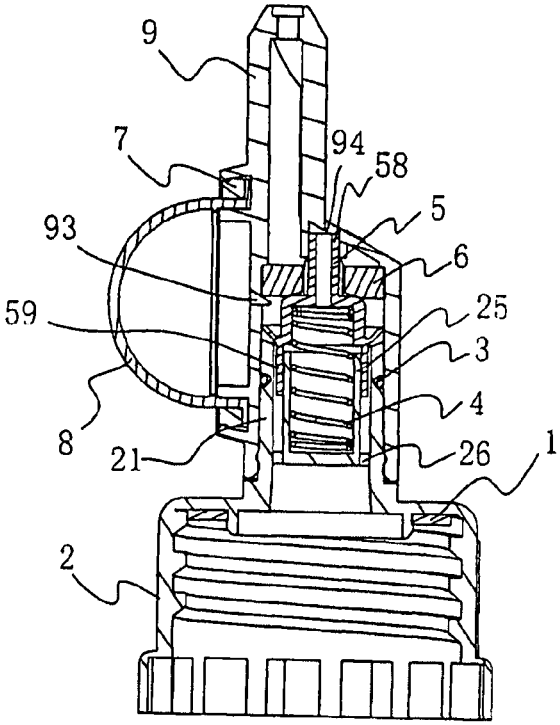
FIG. 14 Structural schematic view of embodiment 3.
Figure 15:
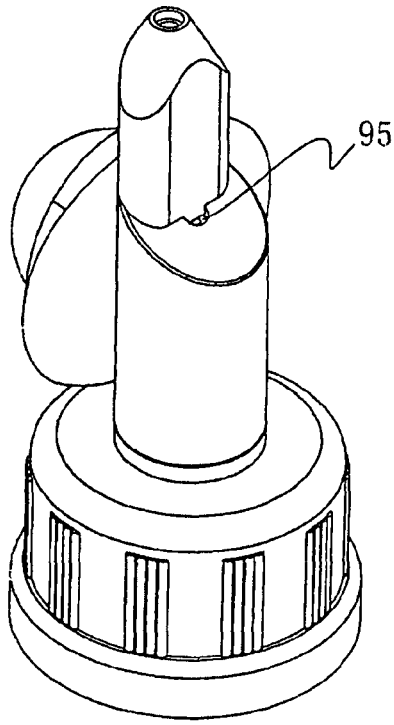
FIG. 15 Outline schematic view of embodiment 3.
Figure 16:
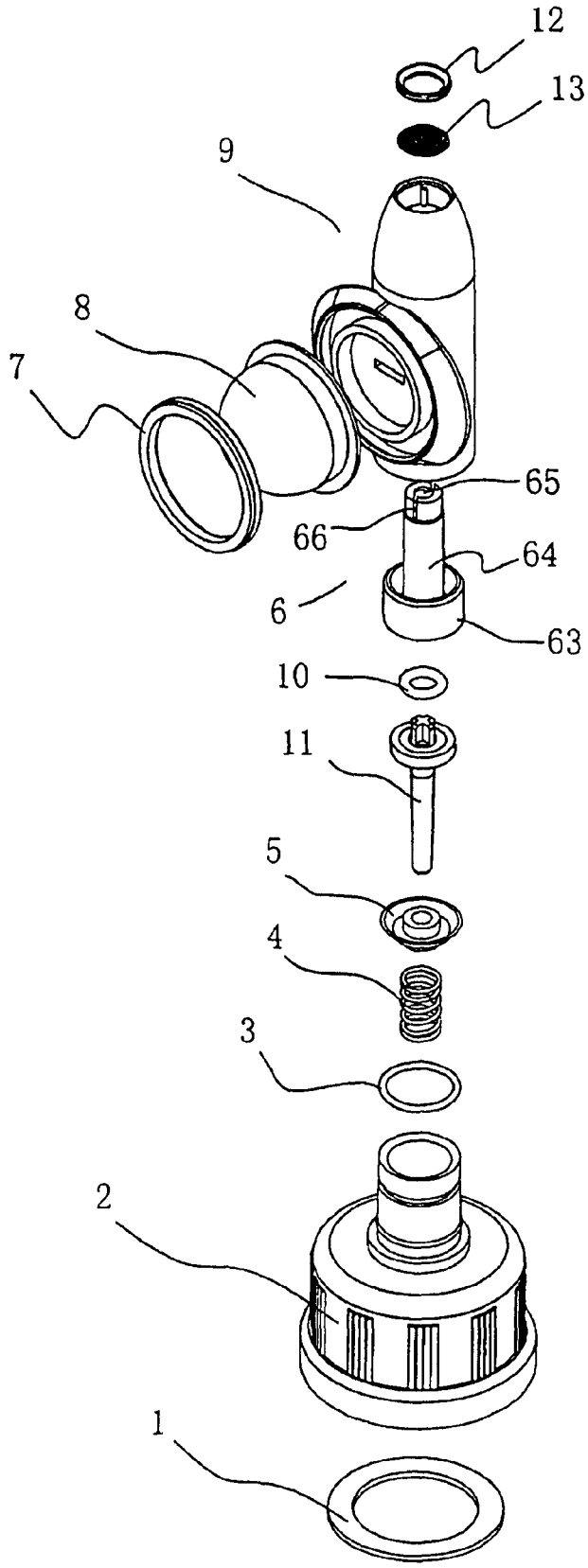
FIG. 16 Exploded 3-D schematic view of yet another embodiment 4 of a liquid dispenser.
Figure 18:
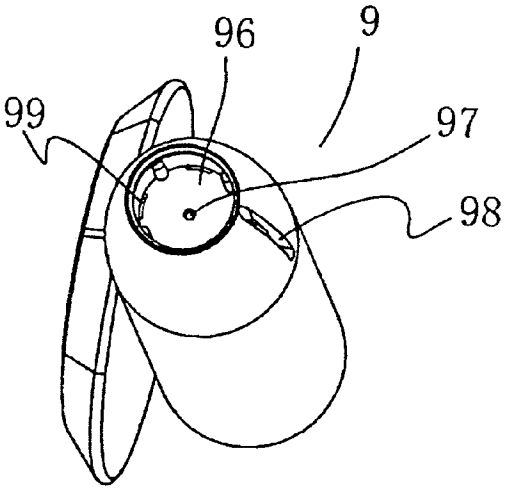
FIG. 18 Schematic view of one embodiment of a main body of embodiment 4.
Figure 17:
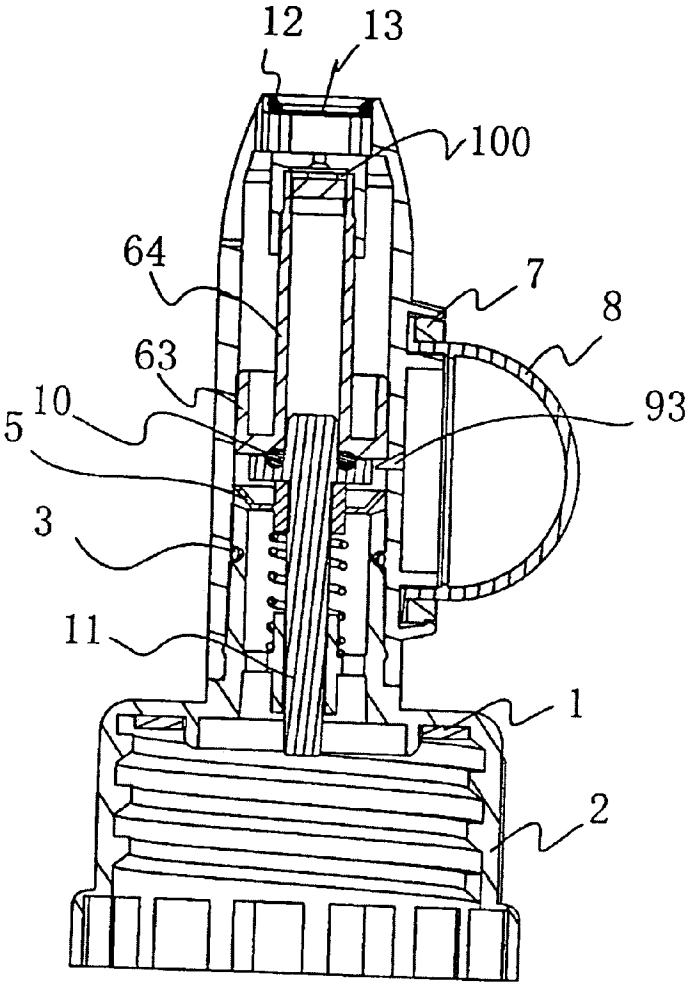
FIG. 17 Structural schematic view of embodiment 4.
Figure 19:
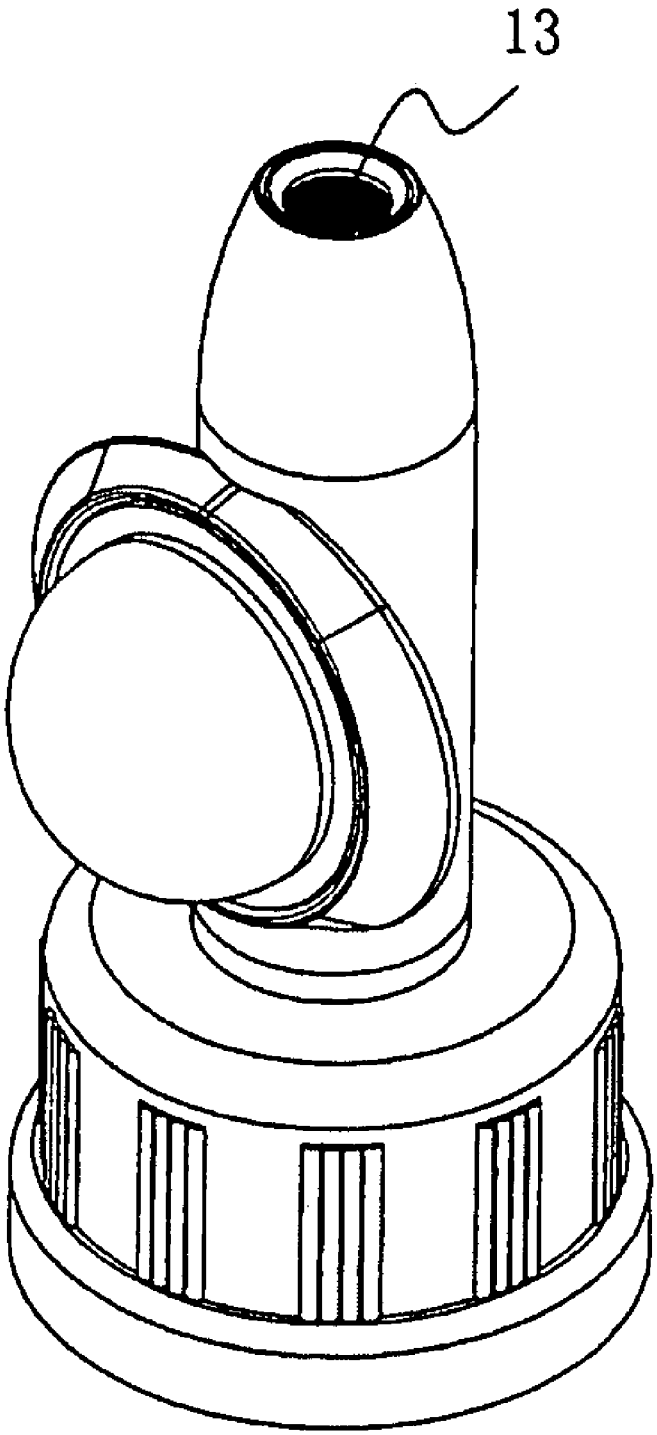
FIG. 19 Outline schematic view of embodiment 4.

Specifically, as shown in FIG. 13-FIG. 15, the valve plate 5 as shown in the drawings of this embodiment is made on the basis of the valve plate in the embodiment 1 and further extend upward and downward from its upper part and lower part respectively a circular tube 58, 59, and a chamber 94 is formed in the main body 9 and receivable of the upper circular tube 58. An opening 95 is arranged at the top part of the chamber. The upper circular tube 58 is inserted in the chamber 94 and its outer wall sealingly engages with the inner wall of the chamber 94. The upper part of said cover 2 comprises not only the circular tube 21 used for connecting to the main body but also an inner circular tube 25 with a closed bottom inside the cover 2. Orifices 26 are arranged on the annular bottom surface which is connected with the bottom of the inner circular tube 25. The lower circular tube 59 of said valve plate 5 covers on the inner circular tube 25 of the cover 2 and its inner wall sealingly engages with the outer wall of the inner circular tube 25. Thus, the spring 4 biases against the rear of the valve plate 5 and is positioned in the chamber of the main body 9, and is surrounded by the inner circular tube 25 of the cover 2, the valve plate 5 and the main body 9. The working gas at the ambience of the spring 4 is exhausted through the top part of the chamber 94 and the opening 95 at the top part of the valve plate 5. Then, the liquid passes through the orifices 26 of the cover 2 without touching the ring 4.

Embodiment 4

This embodiment is the modification on the basis of the embodiment 2. It realizes liquid discharge in form of foam for the dispenser mainly by means of changing the shape of the water-sealing ring.

Specifically, as shown in FIG. 16-19, the water-sealing ring 6 in the figures has a circular tube 64, and the circular tube comprises an upper section of reducing radius and on its top part, a depression 65 and two slots 66 which is in communication with the axial opening of the circular tube 64. The liquid enters the depression 65 through the slots 66, and a circular annular plane 63 is formed at the outward extension of the bottom of the circular tube 64. In order to receive the water-sealing ring 6, the shape of the main body 9 is also modified in comparison with the embodiment 2, its center part is designed as a circular tube. The circular annular plane 63 of the lower part of the water-sealing ring sealingly engages with the inner wall of the circular tube of the main body 9. In the opening of the main body 9 there is a partition plate 96, below which there is a cylindrical chamber 100 for receiving the upper section of the water sealing ring 6. The upper section of the water-sealing ring 6 is inserted into the cylindrical chamber 100 and they are sealingly engaged. Said water-sealing ring 6 is positioned between the piston 11 and the partition plate 96 of the main body. There is an orifice 97 to make high-pressure liquid to inject spirally so as to form a water column in mist form. There are four small square holes 99 between the partition plate and the main body wall. At one side of the opening, there is a long slot 98 in communication with the inner chamber of the main body 9. The long slot 98 can mix the products with air throughout the inner chamber when in operation. Additionally, a stainless steel mesh piece 13 is arranged at the opening of the main body. The mesh piece 13 is welded on the locking slot 12. The locking slot is fixed at the opening of the main body by means of the bands at its edge and on the main body. The mesh piece 13 serves the function of rubbing the water column in mist form with air mixed inside against the mesh piece so as to form a foam-like ejection.

The invention claimed is:

1. A liquid dispenser, comprising:

a cover for connecting to an opening of a container;

a main body connected to the cover, the main body comprises:

a chamber in communication with the cover, a liquid outlet for liquid discharge, a liquid output device arranged in the chamber, the liquid output device comprising: a button arranged on the main body for controlling the action of the liquid output device, and a one-way valve arranged on the liquid output device for adjusting the open/close state of a liquid output passage, wherein said liquid output device comprises a piston and a water-sealing ring configured with the piston and positioned in the chamber, a sealing ring coupled with the piston is arranged between the piston and the water-sealing ring; said one-way valve is a valve plate disposed in the main body, the valve plate covers on the piston and is positioned at an opening of the cover, a spring is arranged at the rear of the valve plate; said button is arranged on the main body, and an opening is arranged in the button at a side wall of the main body between the water-sealing ring and the valve plate, and wherein said water-sealing ring comprises a circular tube, and an upper part of the circular tube reduces in radius and includes a top that comprises a depression and two slots in communication with an axial opening of the circular tube, a circular annular plane is formed at an outward extension of a bottom of the circular tube, the circular annular plane engages with a sealing side of an inner wall of the main body, said water-sealing ring is arranged between the piston and a cylindrical chamber at an upper part of the main body, an upper section of the water-sealing ring is inserted into the cylindrical chamber at an upper part of the main body and sealingly engages therewith; an opening of said main body comprises a partition plate at an inner side thereof, orifices are arranged at the partition plate and between the partition plate and the main body wall, and a long slot in communication with the chamber is arranged at one side of the opening.

2. The liquid dispenser according to claim 1, wherein the valve plate is movably positioned with respect to the water-sealing ring.

3. The liquid dispenser according to claim 1, wherein said valve plate comprises a circular tube configured with the piston, the peripheral extension of the circular tube comprises a plate-like annular plane which can engage with a sealing side of the opening of the cover.

4. The liquid dispenser according to claim 1, wherein a cross-section of said piston is in a cross-like shape, an outer wall of an upper part thereof comprises a plurality of axial slots; the upper part and a tail part of said piston are respectively slidingly inserted into an opening of the water-sealing ring and an axial opening of the cover.

5. The liquid dispenser according to claim 3, wherein a cross-section of said piston is in a cross-like shape, an outer wall of an upper part thereof comprises a plurality of axial slots; the upper part and a tail part of said piston are respectively slidingly inserted into an opening of the water-sealing ring and an axial opening of the cover.

6. The liquid dispenser according to claim 1, wherein a top of said cover comprises a circular tube for connecting to the main body, said main body and the circular tube are rotationally engaged, and a sealing ring is arranged at the joint between the main body and the circular tube.

7. The liquid dispenser according to claim 2, wherein a top of said cover comprises a circular tube for connecting to the main body, said main body and the circular tube are rotationally engaged, and a sealing ring is arranged at the joint between the main body and the circular tube.

8. The liquid dispenser according to claim 1, wherein an outer wall of said main body comprises an embedding slot for embedding the button; the outer edge of the button is inserted in the embedding slot and positioned through a retaining ring.

9. The liquid dispenser according to claim 2, wherein an outer wall of said main body comprises an embedding slot for embedding the button; the outer edge of the button is inserted in the embedding slot and positioned through a retaining ring.

10. The liquid dispenser according to claim 1, wherein said opening of said main body comprises a stainless steel mesh piece which is welded on a locking slot.

11. A liquid dispenser, comprising:

a cover for connecting to an opening of a container; and a main body connected to the cover, the main body comprises:

a chamber in communication with the cover, a liquid outlet for liquid discharge, and a liquid output device arranged in the chamber, the liquid output device comprising: a button arranged on the main body for controlling the action of the liquid output device, and a one-way valve arranged on the liquid output device for adjusting the open/close state of a liquid output passage, wherein said liquid output device comprises a water-sealing ring positioned in the chamber of the main body, the water-sealing ring comprises an axial opening at a center thereof; said one-way valve is a valve plate disposed in the main body, the valve plate movably positioned with respect to the water-sealing ring, and a spring at the rear of the valve plate; said button is arranged on the main body, and an opening is arranged in the button at the side wall of the main body between the water-sealing ring and the valve plate, wherein an upper part of said valve plate is a cylindrical body slidingly-engaged with the axial opening of the water-sealing ring, an outer wall of the cylindrical body comprises a plurality of axial slots; a lower part of said valve plate is a cylindrical cover-shaped body including an increasing outer radius and a top surface with a hollow core, which can be engaged with a sealing side of the water-sealing ring, a bottom outward extension of the cover-shaped body having a plate-like annular plane which can engage with a sealing side of an opening of the cover, and wherein said valve plate comprises upper and lower circular tubes extending upwards on the upper part and downwards on the lower part respectively, wherein said main body comprises a chamber receivable of the upper circular tube, the upper circular tube is inserted into the chamber and is sealingly engaged with the chamber, a circular tube of the upper part of said cover comprises an inner circular tube with a closed bottom, orifices are arranged on a part connecting with the bottom of the inner circular tube, the lower circular tube of said valve plate covers the inner circular tube of the cover, and the lower circular tube sealingly engages with the inner circular tube.

* * * * *